US009366085B2

(12) United States Patent
Panahi

(10) Patent No.: US 9,366,085 B2
(45) Date of Patent: Jun. 14, 2016

(54) APPARATUS FOR DIRECTIONAL DRILLING

(75) Inventor: Massoud Panahi, Katy, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 653 days.

(21) Appl. No.: 13/807,200

(22) PCT Filed: Jun. 29, 2010

(86) PCT No.: PCT/US2010/040444

§ 371 (c)(1),
(2), (4) Date: Mar. 15, 2013

(87) PCT Pub. No.: WO2012/002936

PCT Pub. Date: Jan. 5, 2012

(65) Prior Publication Data

US 2013/0168152 A1 Jul. 4, 2013

(51) Int. Cl.

| | |
|---|---|
| ***E21B 7/04*** | (2006.01) |
| ***E21B 7/06*** | (2006.01) |
| ***E21B 17/20*** | (2006.01) |

(52) U.S. Cl.

CPC ... *E21B 7/04* (2013.01); *E21B 7/06* (2013.01); *E21B 7/062* (2013.01); *E21B 7/067* (2013.01); *E21B 17/20* (2013.01)

(58) Field of Classification Search

USPC ..... 175/61, 75, 73, 74

See application file for complete search history.

(56) References Cited

U.S. PATENT DOCUMENTS

| | | | | |
|---|---|---|---|---|
| 3,098,534 | A | 7/1963 | Farrell et al. | |
| 5,399,042 | A * | 3/1995 | Ivel | 403/165 |
| 5,727,641 | A | 3/1998 | Eddison et al. | |
| 6,234,259 | B1 | 5/2001 | Kuckes et al. | |
| 6,461,268 | B1 | 10/2002 | Milner | |
| 6,708,782 | B1 * | 3/2004 | Turney | 175/40 |
| 2001/0052427 | A1 | 12/2001 | Eppink et al. | |
| 2004/0262043 | A1 | 12/2004 | Schuaf | |
| 2005/0247489 | A1 | 11/2005 | Jamieson | |
| 2008/0110673 | A1 * | 5/2008 | Giroux et al. | 175/5 |

OTHER PUBLICATIONS

International Search Report issued in PCT/US2010/040444 mailed on Mar. 4, 2011, 3 pages.

International Preliminary Report on Patentability issued in PCT/US2010/040444 mailed on Jan. 17, 2013, 8 pages.

* cited by examiner

*Primary Examiner* — Taras P Bemko

(74) *Attorney, Agent, or Firm* — Adolph Locklar

(57) ABSTRACT

A downhole drilling apparatus includes an assembly having a longitudinal axis, wherein an output shaft of the assembly extends axially through a housing. A bearing assembly has first and second races, wherein a first set of bearing elements are disposed at a first angle relative to a top surface of the first race and a second set of bearing elements are disposed at a second angle relative to a top surface of the second race. The output shaft extends from an outlet of the housing at the angle defined by the bore.

16 Claims, 10 Drawing Sheets

APPARATUS FOR DIRECTIONAL DRILLING

BACKGROUND

The present disclosure relates generally to directional drilling of boreholes in the earth, and more particularly down-hole assemblies employed for drilling boreholes in subsurface formations, in the search for hydrocarbons such as oil and natural gas.

It is sometimes necessary to drill in directions other than the vertical direction while exploring for hydrocarbons. Such exploration activity is known as directional drilling. Various tools have been employed to achieve directional drilling in the past. For example, a down-hole motor assembly for alternately drilling straight and inclined borehole sections includes a bent sub and/or housing that is installed downstream of the drill string when it is necessary to drill the inclined borehole section. Use of such motors typically involves time consuming and expensive removal and replacement of down-hole assembly components necessary to drill vertical or straight sections of the borehole.

Another down-hole assembly for alternately drilling straight and inclined borehole sections includes a bearing assembly that supports an output shaft, which is pivotably connected to a motor housing. A remotely controlled positioning system is used to vary the angle between the housing and the output shaft to drill straight or inclined borehole sections as desired. However, the fragility of the pivots between motor housing and the output shaft and the complexity of the remotely controlled positioning system are undesirable.

SUMMARY

A downhole drilling apparatus includes an assembly having a longitudinal axis, wherein an output shaft of the assembly extends axially through a housing. A bearing assembly has first and second races, wherein a first set of bearing elements are disposed at a first angle relative to a top surface of the first race and a second set of bearing elements are disposed at a second angle relative to a top surface of the second race. The output shaft extends from an outlet of the housing at the angle defined by the bore.

An assembly has a longitudinal axis, wherein an output shaft extending from the assembly extends axially through a housing. The output shaft extends from an outlet of the housing at the angle defined by the bore. A bearing assembly includes first and second races, wherein a first set of bearing elements are disposed at a first angle relative to a top surface of the first race and a second set of bearing elements are disposed at a second angle relative to a top surface of the second race. A kick pad is disposed on an outer surface of the housing.

A method of drilling a borehole includes the steps of providing an assembly having a longitudinal axis, wherein an output shaft of the drill motor extends axially through a housing. The output shaft extends from an outlet of the housing at the angle defined by the bore. The method further includes the step of providing a bearing assembly including first and second races, wherein a first set of bearing elements are disposed at a first angle relative to a top surface of the first race and a second set of bearing elements are disposed at a second angle relative to a top surface of the second race.

A downhole drilling apparatus including an assembly having a longitudinal axis, wherein an output shaft of the assembly extends axially through a housing. A bore in the housing defines an angle of at least 0.25 degree with respect to the longitudinal axis of the assembly. The output shaft extends from an outlet of the housing at the angle defined by the bore.

These and other objects and advantages of the invention, as well as the details of an illustrative embodiment, will be more fully understood from the following specification and figures:

DETAILED DESCRIPTION OF THE DRAWINGS

Figure 1:
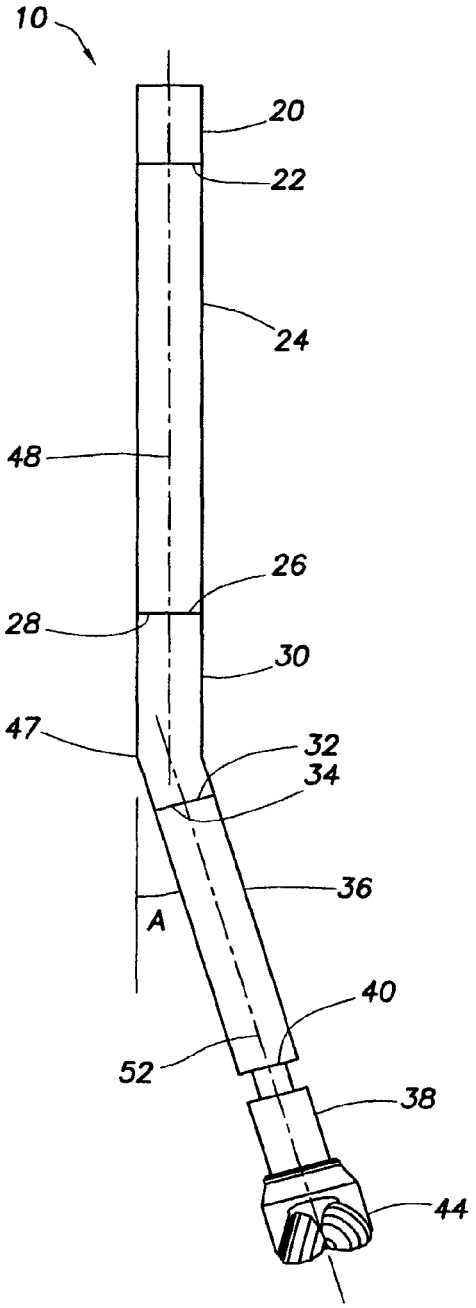
FIG. 1 (PRIOR ART)
FIG. 1 illustrates a side view of prior art directional drilling apparatus.

A typical motor assembly 10 shown in FIG. 1 includes a top sub 20 that extends from a drill string (not shown). The top sub 20 is coupled to a first end 22 of a power section 24. The various components of the drill string discussed herein may be coupled, for example, by cooperatively threaded sections (not shown). Other methods of connecting the components are known to those of skill in the art and details of such methods are not discussed herein. In some embodiments, the top sub 20 may be a bent sub 21 (shown in FIG. 3). A second end 26 of the power section 24 is coupled to a top end 28 of a bent housing 30. A lower end 32 of the bent housing 30 is coupled to a first end 34 of a bearing section 36. An output shaft 38 extends outwardly from a second end 40 of the bearing section 36. The output shaft 38 is coupled to a drill bit 44.

An angle A is defined by a longitudinal axis 48 above a bend point 47 on the bent housing 30 and a longitudinal axis 52 of the bearing section 36. The magnitude of the angle A determines the inclination of a borehole that is drilled with the motor assembly 10. In an embodiment where the angle A is close to or equal to zero degrees, a generally vertical borehole is drilled using the motor assembly 10.

Figure 2:
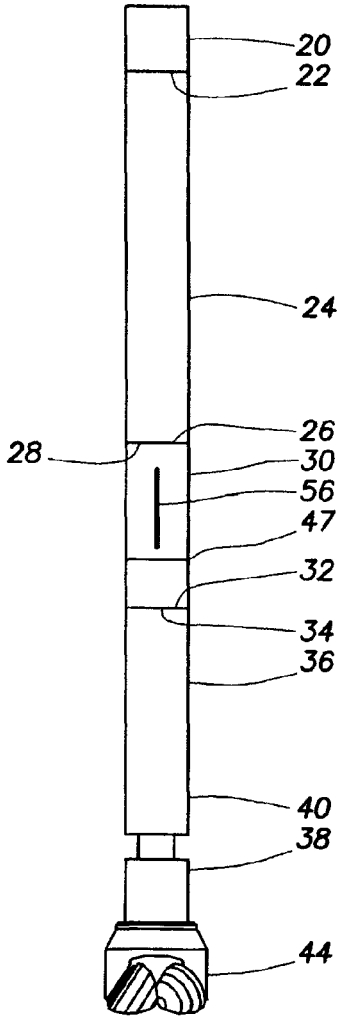
FIG. 2 (PRIOR ART)
FIG. 2 is a front-elevational view of the prior art directional drilling apparatus of FIG. 1.
Figure 3:
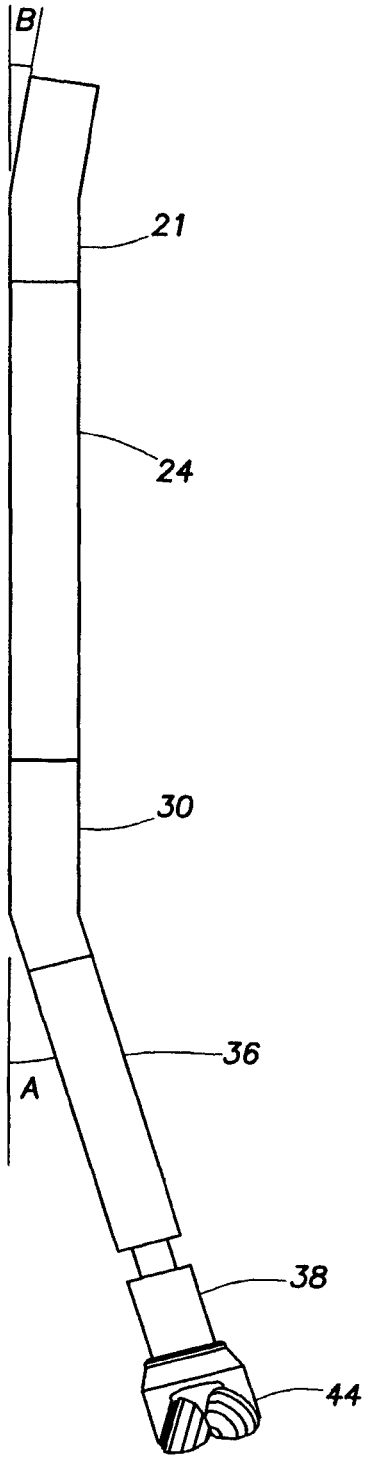
FIG.3 (PRIOR ART)
FIG. 3 illustrates a side view of another prior art directional drilling apparatus.

Turning now to FIG. 2, the bent housing 30 includes a scribe line 56 that is machined thereon. The scribe line 56 is typically used to identify the high side of the bent housing 30 to insure proper orientation of the bent housing 30 in the motor assembly 10. In embodiments incorporating the bent sub 21, a scribe line (not shown) on the bent sub 21 and the scribe line 56 are lined up on the same plane to form a banana assembly as shown in FIG. 3. The banana assembly provides an additional inclination from the longitudinal axis 48 to increase the build rate capability of the motor assembly 10. In other words, the "dogleg" of the borehole can be increased using the banana assembly.

Drilling is typically carried out in either the rotating or sliding modes as known to those of skill in the art. The rotating mode is employed when drilling a straight borehole, wherein it is not desirable to steer the drill in a direction other than the straight direction that is parallel to the longitudinal axis of the drilling motor.

In contrast, the sliding mode is used to steer the drill bit 44 in an inclined direction relative to the longitudinal axis of the bottom hole assembly 10. In the sliding mode, rig pumps (not shown) are turned off and the scribe line 56 of the bent housing 30 (and if incorporated, the bent sub 21) are oriented in the desired drilling direction (or "toolface orientation"). The rig pump is then turned on to steer the drill bit 44 in sliding mode to keep a well bore on a planned trajectory or to correct a stray drill bit back to the planned trajectory in situations where the drill bit 44 has strayed from the planned trajectory.

The motor assembly described above is configured to drill a borehole at a predetermined inclination from the longitudinal axis. The "build rate" of a motor assembly is normally expressed in terms of degrees-per-hundred feet of drilling (deg/100'), and is the angular displacement of the drill bit per 100' of drilling. Normally it is not a constant value. As known to those of skill in the art, the build rate measured in the first 100' of drilling might vary from the second or third 100' of drilling. Several factors influence the build rate capability of the motor assembly. For example, the outside diameter of the motor assembly, the inside diameter of the well bore, hardness of the formation that is being drilled, the type of drill bit used, the magnitude of the bend angle of the bent sub and/or the bent housing, the amount of weight applied to the drill bit, whether stabilizers or kick pads are incorporated and if so, the size and location of such stabilizers and/or kick pads, and the distance from the drill bit to the bend point. All of these factors determine the extent to which a combination of bend, stabilizers and/or pads cause the drill bit to deviate from the longitudinal axis of the well bore. Motor assemblies having a short bend-to-bit length have a higher build rate than motor assemblies with a longer bend-to-bit length. Further, a motor assembly with a larger bend angle typically has a higher build rate than a motor assembly with small bend angle.

The rate of penetration ("ROP") of a motor assembly in the sliding mode is generally lower than the rate of penetration in the rotary mode. The sliding mode results in a lower ROP because the coefficient of friction between the drill string and the subsurface formation is higher in the sliding mode. The resulting frictional losses due to the higher coefficient of friction generally result in a lower weight transfer to the drill bit and thus cause a reduction in the ROP. In addition, the drilling assembly tends to buckle in the sliding mode thereby becoming unable to efficiently transfer applied load to the drill bit. Further, a phenomenon known as "stick-slip" to those of skill in the art occurs while drilling. Stick-slip is defined as energy stored in a drilling assembly. When such stored energy is released, the stored energy causes the drilling assembly to lunge forward at high velocity and then the drilling assembly stops suddenly. Typically, stick-slip occurs again shortly thereafter. This process occurs repeatedly until a drill operator adjusts one of the drilling variables or the formation changes. This stick-slip phenomenon may cause damage to the bit and critical BHA components. Although stick-slip is not exclusive to the sliding mode, its severity as well as the probability of occurrence are much higher compared to the rotary mode of drilling.

One approach to minimize the disadvantages of the sliding mode in drilling projects is to use a bent housing with a short bend length and a large bend angle. In addition, a near bit offset stabilizer or kick pad may be utilized. The combination of these two components tends to increase the build rate. However, the use of a motor assembly with a bend angle of larger than 1.5 degrees is generally not advisable due to excessive stresses that are induced in the bottom hole assembly components and their threaded couplings. Nevertheless, there is a need for a bottom hole assembly that is capable of drilling a borehole with a bend angle that is larger than 1.5 degrees without the risk of damaging components of the bottom hole assembly or the added cost and complexity of tripping out of the borehole to reconfigure the bend angle of a bottom hole assembly.

Figure 4:
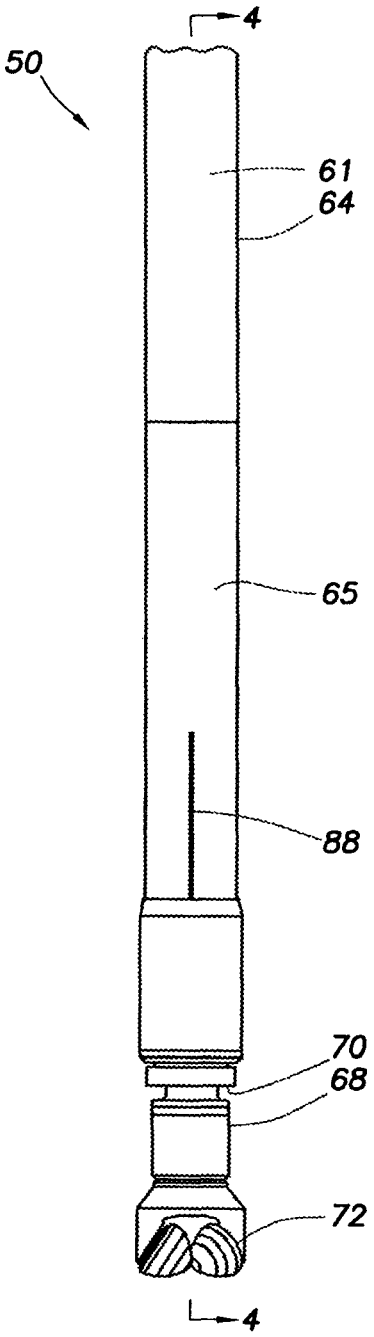
FIG. 4 illustrates a side view of down-hole assembly of the present disclosure.
Figure 5:
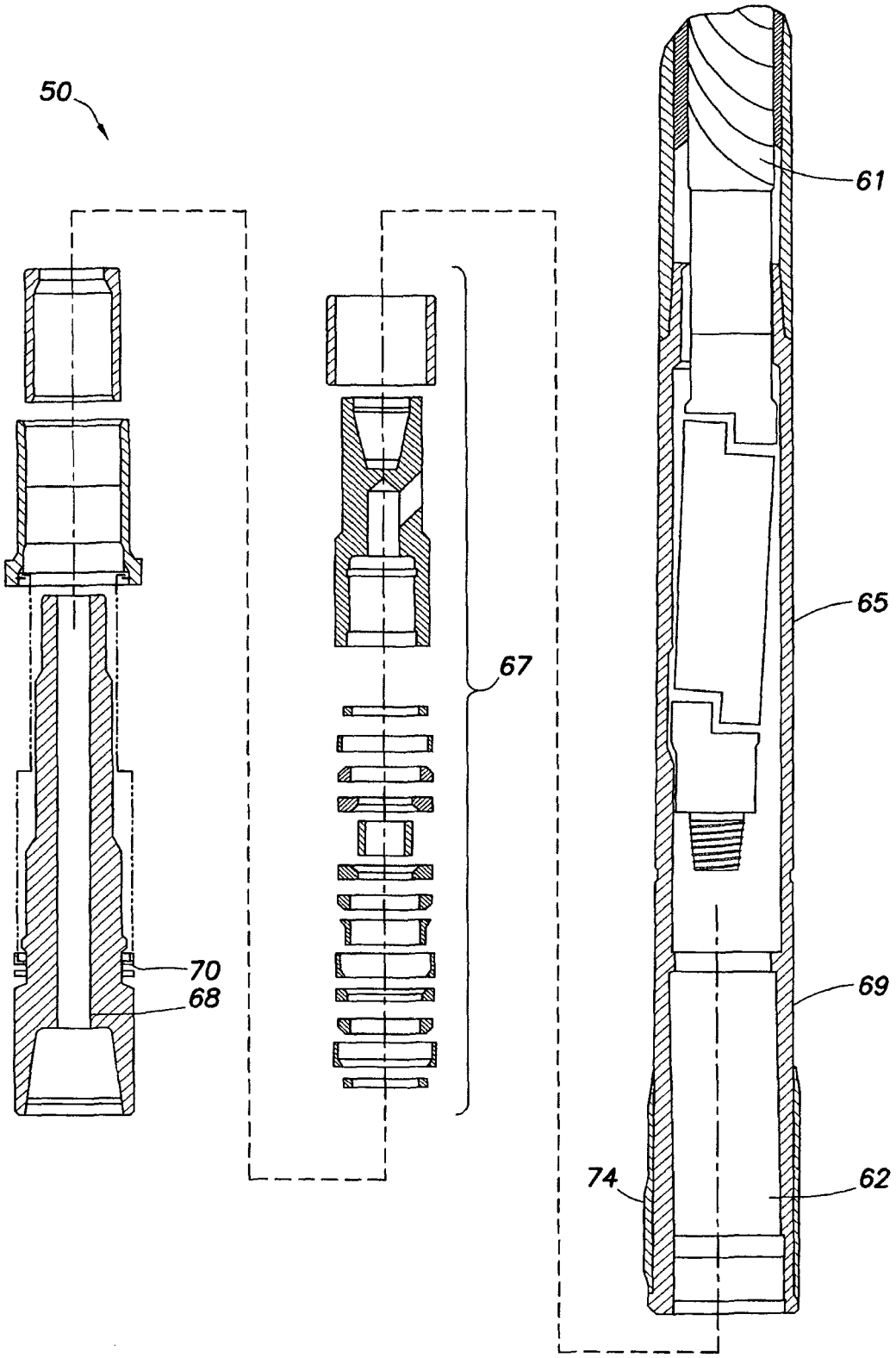
FIG. 5 depicts an exploded sectional view of the down-hole assembly of FIG. 4 taken along the section line 4-4.
Figure 5A:
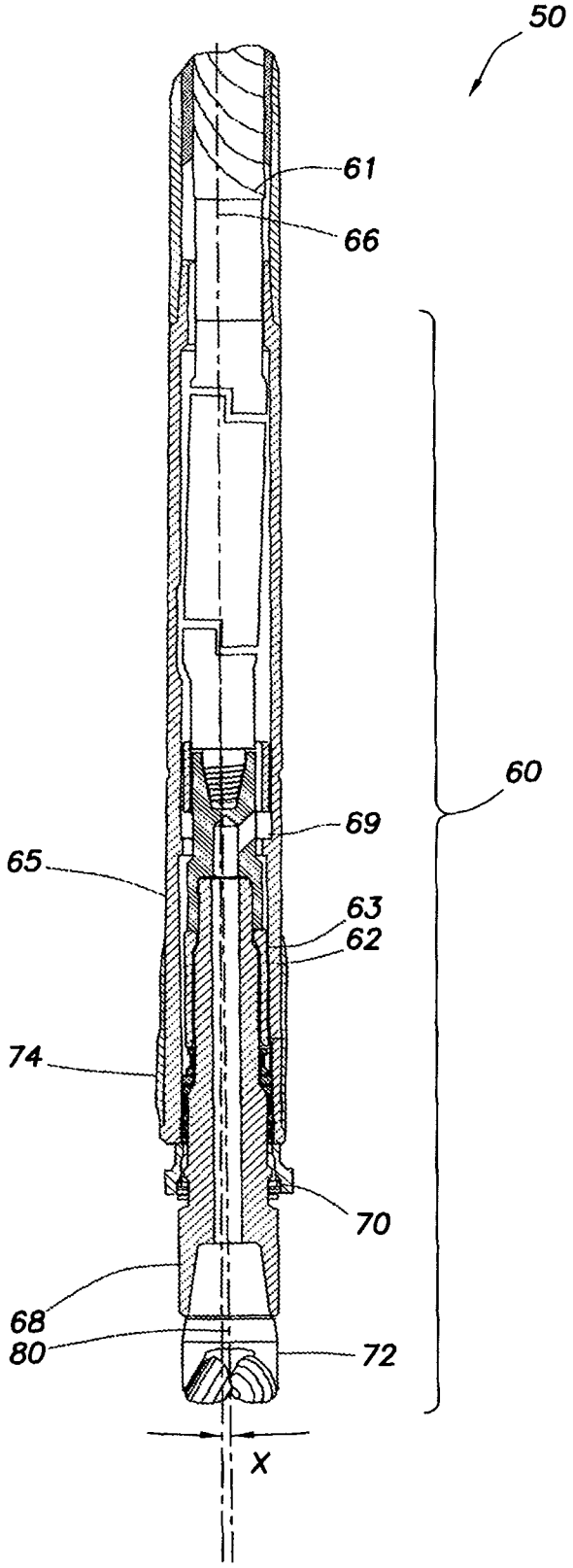
FIG. 5A depicts another sectional view of the down-hole assembly of FIG. 4 taken along the section line 4-4.
Figure 6:
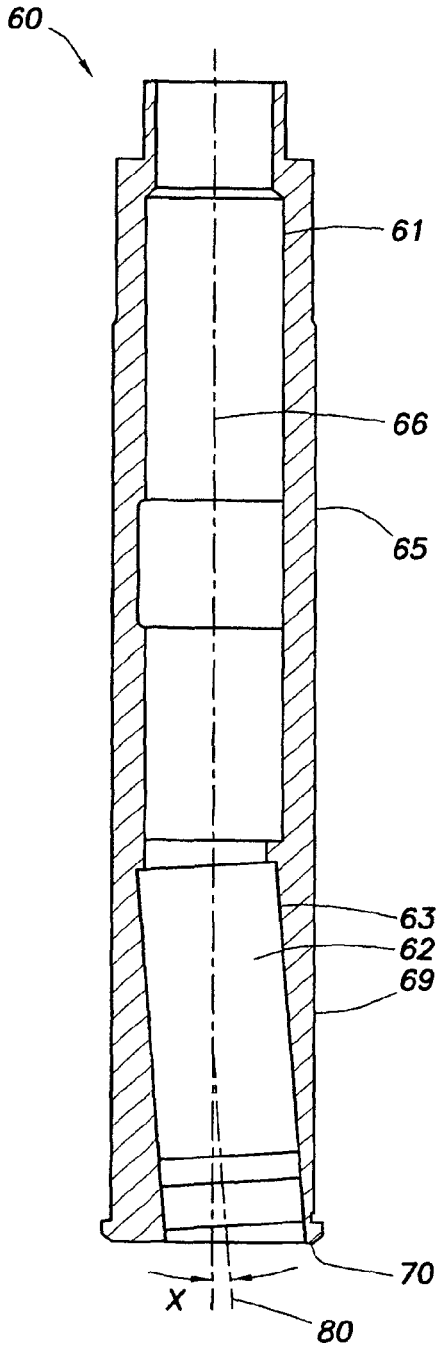
FIG. 6 illustrates a partial sectional view of the down-hole assembly of FIG. 5, wherein some parts are omitted for clarity.

FIGS. 4-6 illustrate a bottom hole assembly 50 including a tilted output shaft 68 of the present disclosure. The assembly 50 includes a power section 61 disposed within a power section housing 64. A bore 62 is machined into a bearing housing 69. A bearing assembly 67 is operatively disposed within the bearing housing 69 as will be understood by those of skill in the art. The present disclosure contemplates that any type of suitable bearing known in the art may be employed with the present disclosure. Such bearings include but are not limited to ball bearings, polycrystalline diamond thrust bearings, roller bearings, open flow, or sealed bearings. The bearing housing 69 has a generally cylindrical outer surface 65. An output shaft 68 of the assembly 50 is coupled to the power section 61. The output shaft 68 extends outwardly through an outlet 70 of the bearing housing 69. A drill bit 72 is operatively coupled with the output shaft 68.

Figure 6A:
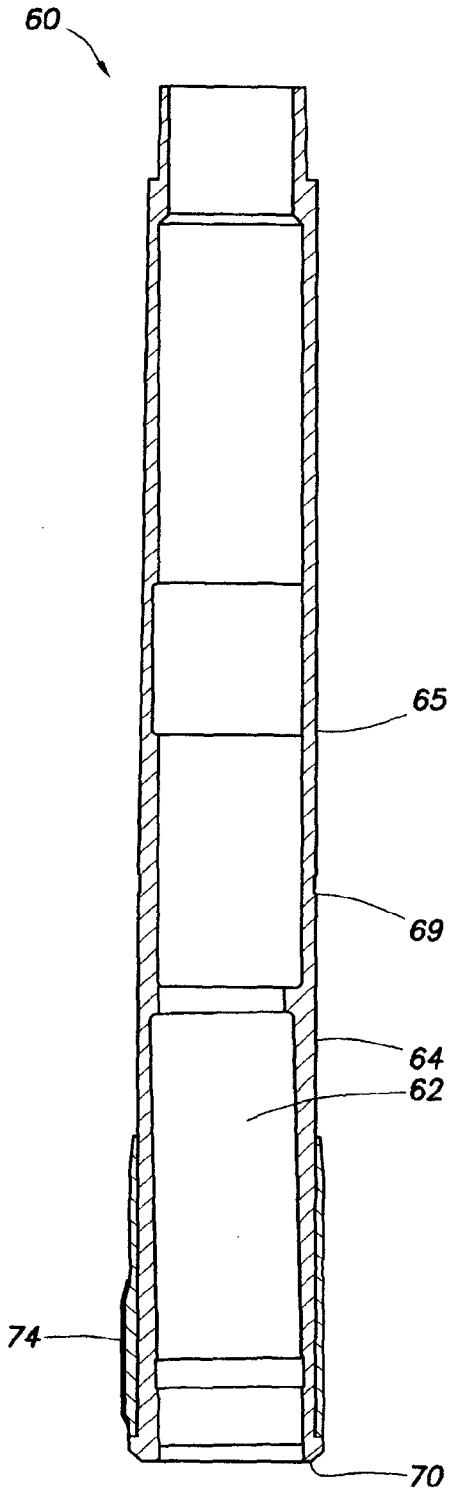
FIG. 6A illustrates a partial sectional view of the down-hole assembly of FIG. 5 with a kick-pad installed.

With continuing reference to FIGS. 5-6A, certain embodiments of the present disclosure include a kick-pad 74 that is attached to the outer surface 65 of the housing 69. The kick-pad 74 may be attached to the outer surface 65 by screws (not shown) or by any suitable methods known to those of skill in the art. For example, the kick pad 74 can be machined as an integral part of the bearing housing 69. In use, the kick-pad 74 acts as a second point of contact on a surface of a borehole and thereby aids in positioning the drill bit 72 to enable a driller control the deviation of a borehole from the vertical axis.

Although the outer surface 65 of the housing 69 is generally cylindrical (i.e., does not include a bend), the bore 62 is machined such that the longitudinal axis 80 of bore 62 defines a bend angle X that is greater than about 0.25 degree relative to the longitudinal axis 66 of the power section 61 in one embodiment. In another embodiment, the bore 62 is machined to define a bend angle of at least 1 degree. In yet another embodiment, the bore 62 is machined to define a bend angle of about 1.5 degree. In another embodiment, the bore 62 is machined to define a bend angle of about 1.75 degree. As would be understood by persons of skill in the art, the bore 62 can be machined to any suitable angle that would provide a bend that is sufficient to achieve the chosen directional drilling objective for any borehole that is intended to deviate from the vertical direction without departing from the spirit of this disclosure. The bend angle X is measured between the longitudinal axis 66 and a bearing bore axis 80. Consequently, the drill bit 72 extends from the housing 69 at an angle of at least 0.25 degree relative to the longitudinal axis 66 of the power section 61. Where necessary, an additional bit offset may be provided in the assembly 50 in embodiments where the kick pad 74 is incorporated. In such embodiments, the bend length of the assembly 50 is measured from the drill bit to the kick-pad 74. In another embodiment, a near bit stabilizer may be disposed near the bit to provide an additional point of contact between the assembly 50 and the surface of the borehole. A scribe line 88 (FIG. 4) is provided as a visual aid to indicate the high side of assembly 50. In all of the above-described embodiments, the assembly 50 eliminates the need for connection between a bent housing and a bearing housing of a bottom hole assembly. Rather, the tilted output shaft 68 replaces the bent housing 30 that is typically separate from the bearing section 36 as discussed with respect to FIGS. 1 and 2. Consequently, the assembly 50 reduces the risk of damage to the additional couplings that are required for such connections.

Further, the assembly 50 eliminates the constraints associated with traditional drilling motors because the assembly 50 is operable at speeds greater than 60 rotary rpm with a relatively low risk of component failure because there are not nearly as many (threaded connections) couplings between various components. Furthermore, because the assembly 50 operates at a higher speed, the assembly 50 generates a higher rate of penetration and provides more efficient hole cleaning than traditional drilling motors. The shorter moment arm of assembly 50 aids directional control, enables the assembly 50 to clean wells better, and causes less stress to components of the assembly 50.

Because there is no bent housing in the assembly 50, boreholes drilled with the assembly 50 will generally have a hole diameter that is closer to the required hole diameter (in gage) than those of boreholes drilled with drilling motors incorporating a bent housing. Further, the assembly 50 is capable of drilling boreholes with sections having higher deviations from the vertical (also known as "dog leg" by those of skill in the art) as well as relatively straight sections.

One way to implement the above-discussed control of the trajectory and/or build rate of a borehole is to simply change the thickness of the kick-pad 74. However, the process of changing detaching the kick-pad 74 and replacing same with another kick-pad could be cumbersome. Further, it would require that an operator maintain an inventory of several kick-pads of varying thicknesses.

Figure 7:
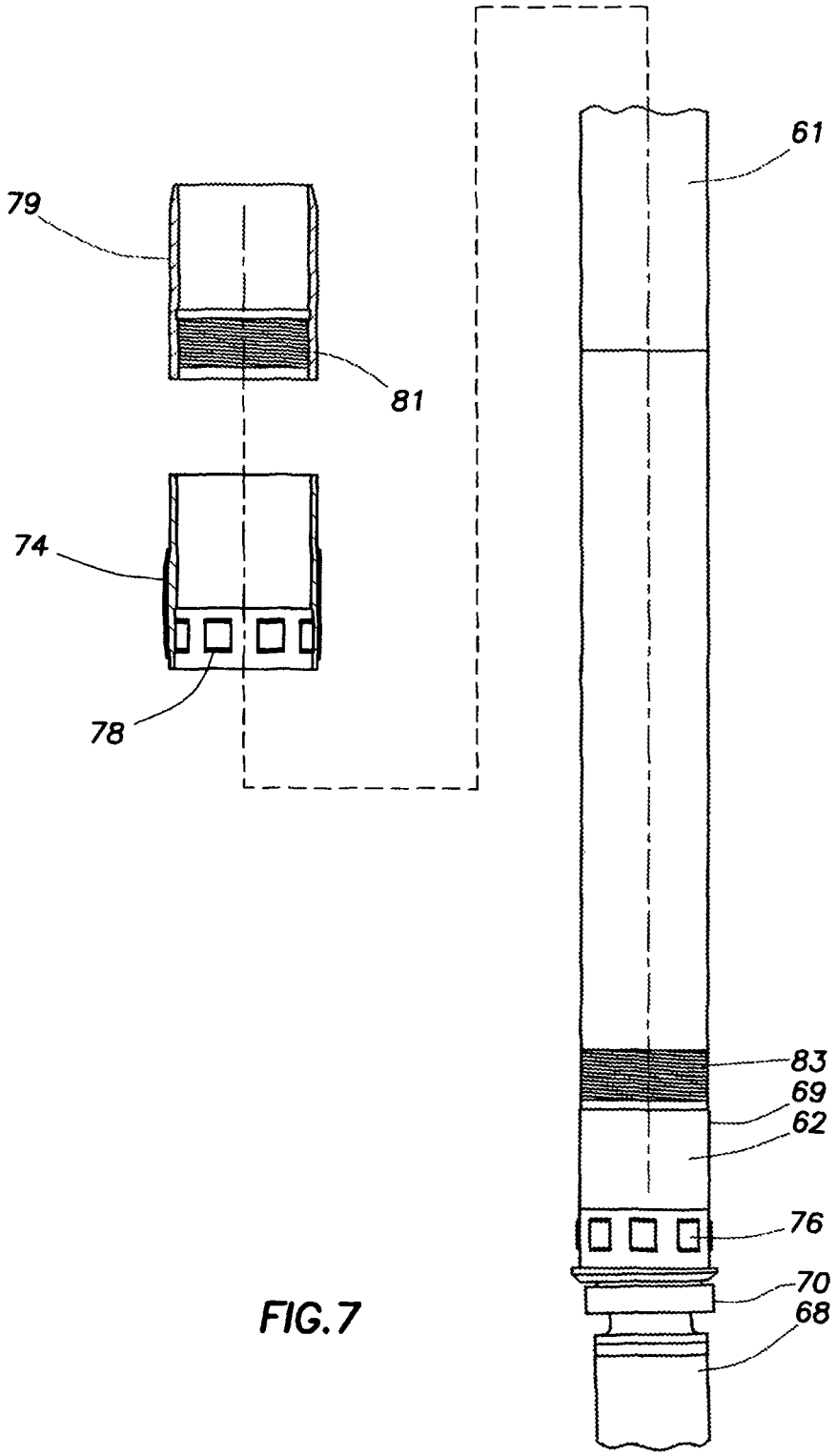
FIG. 7 shows a front elevation of another embodiment of the down-hole assembly of FIG. 4.
Figure 8:
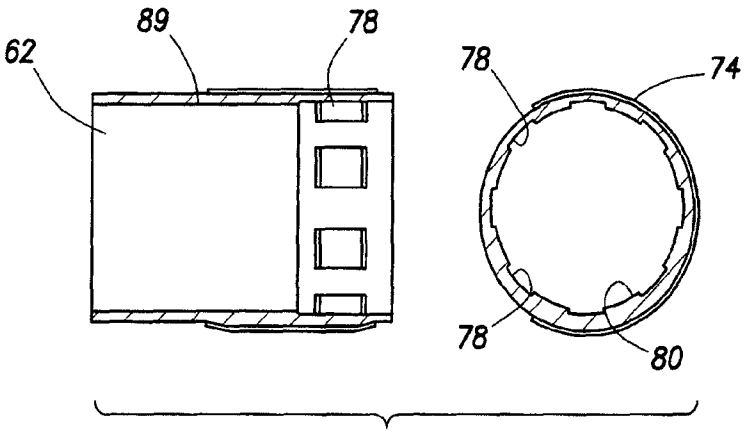
FIG. 8 shows a kick-pad sleeve that may be incorporated in the down-hole assembly of FIG. 7.
Figure 9:
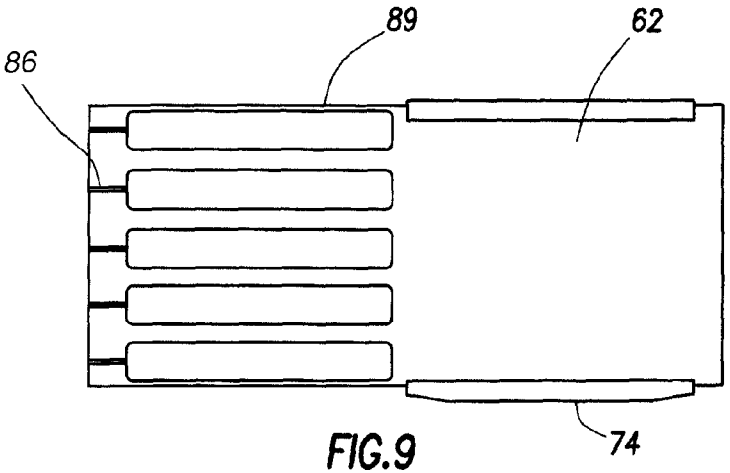
FIG. 9 illustrates side elevation of the kick-pad sleeve of FIG. 8.

Instead, some embodiments of the present disclosure incorporate a kick pad 74 that is an adjustable kick-pad as shown in FIGS. 7-9. Specifically, a series of splines 76 extend outwardly around the outer circumference of the outer surface 65 and are adapted to mate with internal splines 78 that are machined into an inner diameter 80 of the kick-pad 74 (FIG. 8). As shown in FIG. 8, the inner diameter 80 is machined eccentrically in relation to the outer diameter of the kick pad 74. Turning now to FIG. 9, each spline 76 is marked with a hole size and a corresponding build rate (FIG. 9). For example, to drill a borehole with a build rate of 13 degree/100' and an 8.5 inch holes size, a drill operator will align scribe line 86 with the main scribe line 88 (FIG. 4) and engage a jam nut 79 having a threaded end 81 with a corresponding threaded section 83 disposed on the outer surface 65. The drill operator can adjust the thickness of the kick-pad 74 by simply backing off the jam nut and aligning the scribe line 88 with the appropriate scribe line on the kick-pad sleeve 86 and making up the jam nut, as will be understood by those of skill in the art.

In some embodiments a combination bearing assembly 90, may be incorporated to provide radial and axial support during drilling operations. The assembly 50 may experience radial loading due to forces acting on the assembly 50 that are generally perpendicular to the vertical axis of the borehole. The assembly 50 may also be subject to axial forces that are generally parallel to the vertical axis of the borehole.

Figure 11:
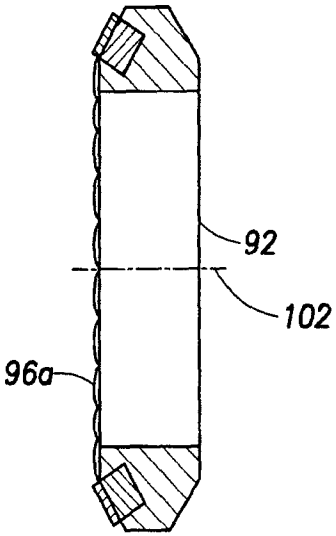
FIGS. 10-14 show bearings that may be incorporated in one embodiment of the down-hole assembly of the present disclosure.
Figure 10:
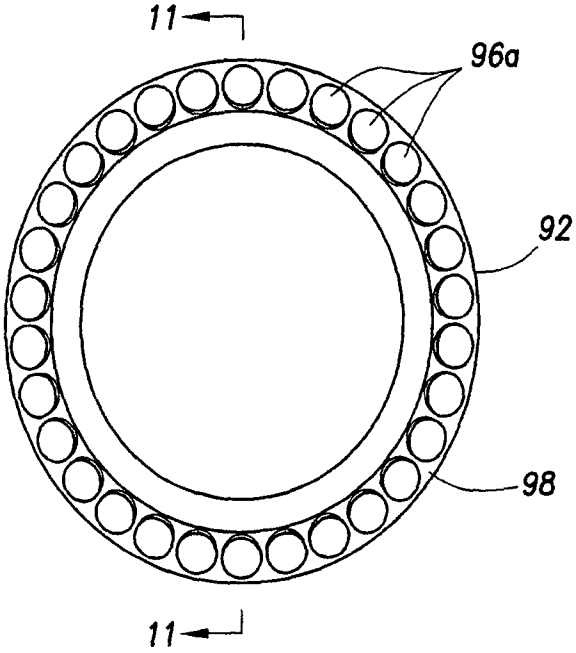
Figure 13:
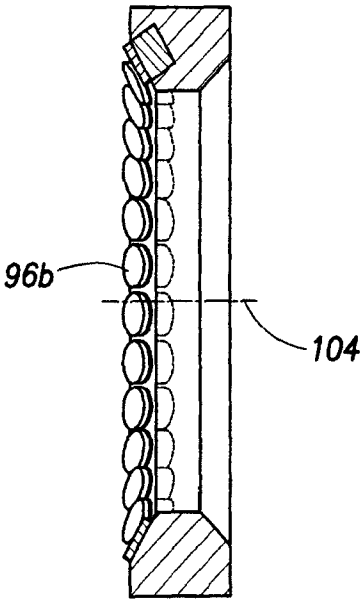
Figure 12:
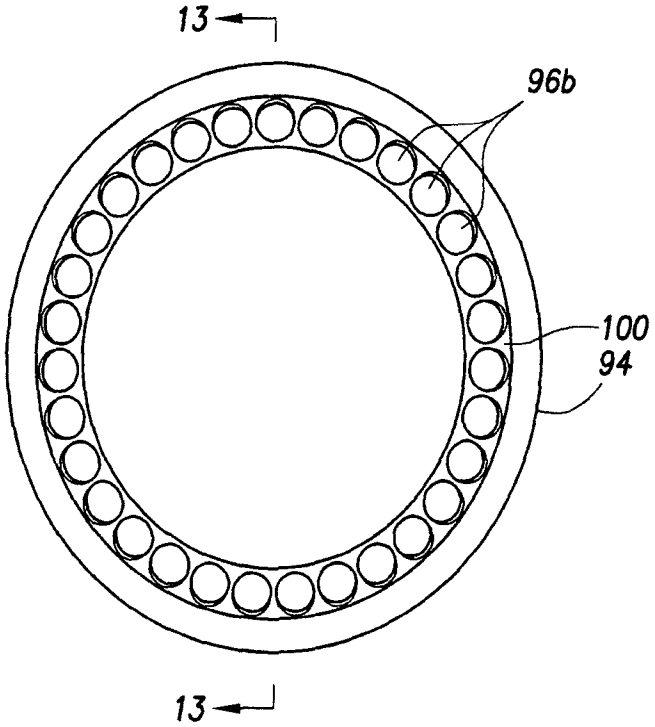
Figure 14:
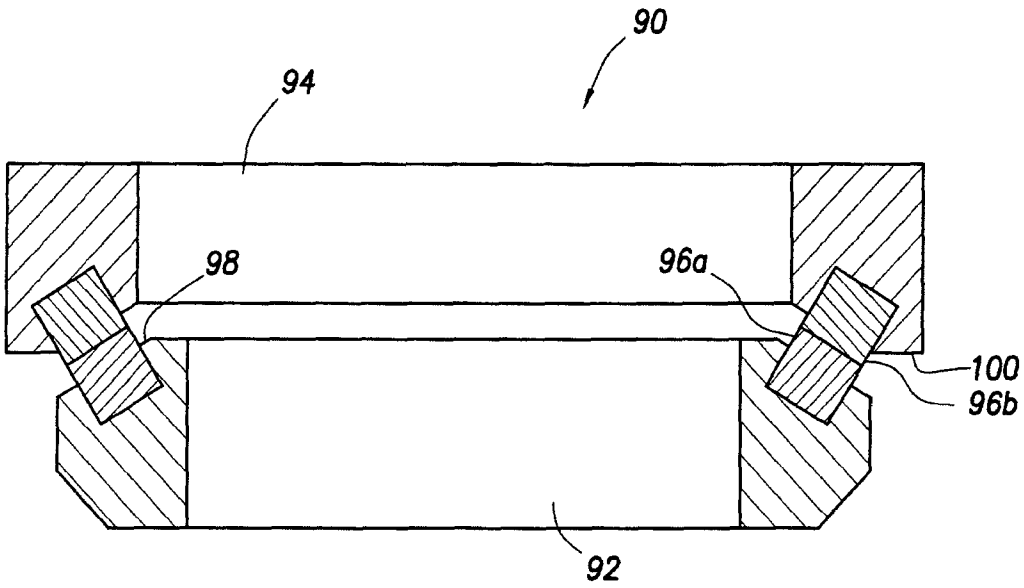

As illustrated in FIGS. 10-14, a combination bearing assembly 90 that has first and second races 92, 94. The combination bearing assembly 90 may be incorporated in the down-hole assembly of FIG. 5 instead of the bearing 67. Bearing elements or buttons 96*a*, 96*b* are equidistantly spaced and disposed within top surfaces 98, 100 of races 92, 94, respectively. The bearing elements 96*a*, 96*b* extend upwardly from the top surfaces of the races 92, 94 (FIG. 14). As can be seen in FIGS. 10-12, the elements or buttons 96*a* are inclined relative to an axial axis 102 of the race 92. Similarly, the elements or buttons 96*b* are inclined relative to an axial axis 104 of the race 94. The buttons 96*a* and 96*b* are operably inclined at substantially the same angles relative to the respective races. The buttons can be disposed at any angle required to provide the necessary radial support. One example of the inclination than can be implemented is 30 degrees. In one embodiment, components of the combination bearing assembly 90 are made of polycrystalline diamond material. In another embodiment, other materials as know to those of ordinary skill in the art can be utilized. In operation, races 92, 94 are juxtaposed such that the top surfaces 98, 100 abut one another and the inclined buttons 96*a*, 96*b* contact one another to provide radial and axial support when the motor of the assembly 50 is activated.

What is claimed is:

1. A downhole drilling apparatus comprising:

an assembly including a housing having a longitudinal axis, the housing having a bore formed therein, the bore having a bore longitudinal axis, the bore longitudinal axis being at an angle to the longitudinal axis of the housing at an outlet of the housing, wherein an output shaft of the assembly extends axially through the bore of the housing;

a bearing assembly including first and second races, wherein a first set of bearing elements are disposed at a first angle relative to a top surface of the first race and a second set of bearing elements are disposed at a second angle relative to a top surface of the second race; and the output shaft extends from the outlet of the housing at an angle, the angle defined by the angle between the bore longitudinal axis and the longitudinal axis of the housing.

2. The downhole drilling apparatus of claim 1, further including a field adjustable kick pad.

3. The downhole drilling apparatus of claim 2, wherein the bore in the housing defines an angle that is greater than 0.25 degrees.

4. The downhole drilling apparatus of claim 1, wherein a scribe line is machined on the housing to indicate a direction of the angle.

5. A downhole drilling apparatus comprising:

an assembly having a longitudinal axis, wherein an output shaft extending from the assembly extends axially through a housing having a longitudinal axis, the housing having a bore formed therein, the bore having a bore longitudinal axis, the bore longitudinal axis being at an angle to the longitudinal axis of the housing at an outlet of the housing;

wherein the output shaft extends from the outlet of the housing at an angle defined by the angle between the bore longitudinal axis and the longitudinal axis of the housing;

a bearing assembly including first and second races, wherein a first set of bearing elements are disposed at a first angle relative to a top surface of the first race and a second set of bearing elements are disposed at a second angle relative to a top surface of the second race; and a kick pad disposed on an outer surface of the housing.

6. The downhole drilling apparatus of claim 5, wherein the kick pad is field adjustable.

7. The downhole directional drilling apparatus of claim 6, wherein the bore in the housing defines an angle that is greater than 0.25 degrees.

8. The downhole drilling apparatus of claim 6, wherein a scribe line is machined on the housing to indicate a direction of the angle.

9. A method of drilling a borehole including the steps of:

providing an assembly including a housing having a longitudinal axis, the housing having a bore formed therein, the bore having a bore longitudinal axis, the bore longitudinal axis being at an angle to the longitudinal axis of the housing at an outlet of the housing, wherein an output shaft of the drill motor extends axially through the bore of the housing;

wherein the output shaft extends from the outlet of the housing at an angle defined by the angle between the bore longitudinal axis and the longitudinal axis of the housing; and providing a bearing assembly including first and second races, wherein a first set of bearing elements are disposed at a first angle relative to a top surface of the first race and a second set of bearing elements are disposed at a second angle relative to a top surface of the second race.

10. The method of claim 9, further including the step of providing a field adjustable kick pad disposed on the assembly housing.

11. The method of claim 10, including the further step of steering the assembly such that a drill bit extending from the housing defines an angle that is greater than 0.25 degree.

12. A downhole drilling apparatus comprising:

an assembly including a housing having a longitudinal axis, the housing having a bore formed therein, the bore having a bore longitudinal axis, the bore longitudinal axis being at an angle to the longitudinal axis of the housing at an outlet of the housing, wherein an output shaft of the assembly extends axially through the bore of the housing;

wherein the bore longitudinal axis of the bore in the housing defines an angle of at least 0.25 degree with respect to the longitudinal axis of the assembly; and the output shaft extends from the outlet of the housing at an angle defined by the angle between the bore longitudinal axis and the longitudinal axis of the housing.

13. The downhole drilling apparatus of claim 12, further including a field adjustable kick pad.

14. The downhole drilling apparatus of claim 12, wherein a scribe line is machined on the housing to indicate a direction of the angle.

15. The downhole drilling apparatus of claim 12, further including a sleeve that is adapted to mate with splines disposed on the housing.

16. The downhole drilling apparatus of claim 15, wherein the sleeve is retained in an operative position by a jam nut.

* * * * *